US009238540B2

(12) United States Patent
Wyner et al.

(10) Patent No.: US 9,238,540 B2
(45) Date of Patent: Jan. 19, 2016

(54) PROTECTIVE EDGE INSERTS AND CASES INCLUDING SUCH INSERTS

(71) Applicant: G-Form, LLC, Providence, RI (US)

(72) Inventors: Daniel M. Wyner, North Scituate, RI (US); Thomas Cafaro, Foster, RI (US); Maria E. Macrina, Providence, RI (US)

(73) Assignee: G-Form, LLC, Providence, RI (US)

( * ) Notice: Subject to any disclaimer, the term of this patent is extended or adjusted under 35 U.S.C. 154(b) by 0 days.

(21) Appl. No.: 13/657,057

(22) Filed: Oct. 22, 2012

(65) Prior Publication Data

US 2013/0105354 A1 May 2, 2013

Related U.S. Application Data

(60) Provisional application No. 61/549,715, filed on Oct. 20, 2011.

(51) Int. Cl.

| | |
|---|---|
| ***B65D 81/03*** | (2006.01) |
| ***B65D 81/05*** | (2006.01) |
| ***B65D 81/127*** | (2006.01) |
| ***A45C 13/02*** | (2006.01) |
| ***A45C 13/36*** | (2006.01) |

(52) U.S. Cl.

CPC ..... *B65D 81/053* (2013.01); *A45C 13/02* (2013.01); *A45C 13/36* (2013.01); *B65D 81/1275* (2013.01); *A45C 2013/025* (2013.01)

(58) Field of Classification Search

CPC ..... B65D 5/5033; B65D 81/053–81/058; B65D 2581/051–2581/053; B65D 2581/055

USPC ..... 206/453, 523, 586–589; 248/345.1; 428/119, 122

See application file for complete search history.

(56) References Cited

U.S. PATENT DOCUMENTS

| | | | | | |
|---|---|---|---|---|---|
| 2,556,529 | A | * | 6/1951 | Farrell | 206/453 |
| 2,741,362 | A | * | 4/1956 | Cortright | 206/453 |
| 2,746,667 | A | * | 5/1956 | Murphy | 206/454 |
| 3,181,766 | A | * | 5/1965 | Kane et al. | 206/589 |
| 3,339,722 | A | * | 9/1967 | Van Antwerpen | 206/453 |
| 3,362,609 | A | * | 1/1968 | Freedy | 206/588 |
| 3,516,538 | A | * | 6/1970 | Van Antwerpen | 206/453 |
| 3,990,576 | A | * | 11/1976 | Heaney | 206/453 |
| 4,243,140 | A | | 1/1981 | Thrun | |
| 4,700,844 | A | * | 10/1987 | Griffith | 206/586 |
| 4,784,269 | A | * | 11/1988 | Griffith | 206/453 |
| 4,901,852 | A | | 2/1990 | King | |
| 5,180,060 | A | | 1/1993 | Forti et al. | |
| 5,265,720 | A | | 11/1993 | Meliconi | |
| 5,386,911 | A | * | 2/1995 | Payne | 206/586 |
| 5,622,262 | A | | 4/1997 | Sadow | |
| 5,755,331 | A | | 5/1998 | Watson | |
| 5,819,942 | A | | 10/1998 | Sadow | |

(Continued)

FOREIGN PATENT DOCUMENTS

WO WO 2010041023 A1 * 4/2010

OTHER PUBLICATIONS

Rogers Corporation, Shaping Up Your Impact Protection, Publication No. 15C-073.

*Primary Examiner* — Bryon Gehman

(74) *Attorney, Agent, or Firm* — Michele J. Young

(57) ABSTRACT

Disclosed herein are protective inserts for sensitive devices, including devices with screen interfaces, which cases provide protection from front, back and edge impacts.

19 Claims, 19 Drawing Sheets

(56) References Cited

U.S. PATENT DOCUMENTS

| | | | | |
|---|---|---|---|---|
| 6,109,434 | A | 8/2000 | Howard, Jr. | |
| 6,131,734 | A | 10/2000 | Hollingsworth et al. | |
| 6,237,766 | B1 | 5/2001 | Hollingsworth | |
| 6,334,533 | B1 | 1/2002 | Hollingsworth et al. | |
| 6,334,534 | B1 | 1/2002 | Hollingsworth et al. | |
| 6,390,297 | B1 | 5/2002 | Hollingsworth et al. | |
| 7,727,614 | B2 * | 6/2010 | Stubing | 428/119 |
| 7,938,260 | B2 | 5/2011 | Lin | |
| 8,191,706 | B1 | 6/2012 | Liu | |
| 8,245,842 | B2 | 8/2012 | Bau | |
| 8,302,769 | B2 | 11/2012 | Justiss | |
| 8,342,325 | B2 | 1/2013 | Rayner | |
| 8,439,191 | B1 | 5/2013 | Lu | |
| 8,453,835 | B2 | 6/2013 | So | |
| 8,871,328 | B2 * | 10/2014 | Wyner et al. | 428/156 |
| 2002/0060165 | A1 | 5/2002 | Weder | |
| 2002/0175096 | A1 | 11/2002 | Linihan | |
| 2005/0000833 | A1 | 1/2005 | Nettleton | |
| 2005/0139498 | A1 | 6/2005 | Goros | |
| 2007/0158220 | A1 | 7/2007 | Cleereman et al. | |
| 2007/0261978 | A1 | 11/2007 | Sanderson | |
| 2008/0053852 | A1 | 3/2008 | Ko et al. | |
| 2008/0166524 | A1 | 7/2008 | Skaja et al. | |
| 2009/0032421 | A1 | 2/2009 | Sween et al. | |
| 2009/0035524 | A1 | 2/2009 | Wyner et al. | |
| 2009/0255625 | A1 | 10/2009 | Fox et al. | |
| 2010/0006468 | A1 | 1/2010 | Lin | |
| 2010/0089779 | A1 | 4/2010 | Bowers | |
| 2010/0096284 | A1 | 4/2010 | Bau | |
| 2010/0147737 | A1 | 6/2010 | Richardson et al. | |
| 2012/0018323 | A1 | 1/2012 | Johnson et al. | |
| 2012/0018325 | A1 | 1/2012 | Kim | |
| 2012/0031788 | A1 | 2/2012 | Mongan et al. | |
| 2012/0037524 | A1 | 2/2012 | Lonsdale, II et al. | |
| 2012/0091025 | A1 | 4/2012 | Wyner et al. | |
| 2012/0261289 | A1 | 10/2012 | Wyner et al. | |
| 2012/0305422 | A1 | 12/2012 | Vandiver | |
| 2013/0020229 | A1 | 1/2013 | Wyner | |
| 2013/0092562 | A1 | 4/2013 | Wyner et al. | |
| 2013/0092576 | A1 | 4/2013 | Rayner | |
| 2013/0098788 | A1 | 4/2013 | McCarville et al. | |
| 2013/0098790 | A1 | 4/2013 | Hong et al. | |
| 2014/0144792 | A1 | 5/2014 | Wyner et al. | |

* cited by examiner

PROTECTIVE EDGE INSERTS AND CASES INCLUDING SUCH INSERTS

CROSS-REFERENCE TO RELATED APPLICATIONS

The present application claims priority to U.S. Provisional Application No. 61/549,715, which was filed on Oct. 20, 2011, which is incorporated herein by reference in its entirety.

TECHNICAL FIELD

The disclosure relates to flexible impact protective inserts for cases, and to case containing such inserts.

BACKGROUND

"Laptop" and "notebook" portable electronic devices have a small form factor and reduced weight for convenience when traveling. Manufacturers of such devices strive to provide the smallest, lightest devices possible. Unfortunately, it is difficult to manufacture a small, lightweight, portable computer that is rugged enough to withstand being dropped or otherwise subjected to shock loading. The small size of today's portable computers leaves little or no internal room for shock absorbing materials to protect the vulnerable operating parts of the computer such as the LCD screen, the hard drive, the various electrical connectors or the outer case.

Each computer manufacturer's design is different, and so there is no universally safe level of shock for portable computers. Manufacturers of LCD screens typically do not guarantee their screens to withstand shocks that arise from a drop of more than a few inches. Because carrying cases for portable computers are usually hand held or hung from shoulder straps more than six inches from the ground, it is important that the cases provide adequate protection from the falls and bumps typically encountered in every day travel and use.

Many manufacturers of carrying cases for portable computers incorporate foam padding into their cases. Foam padding will protect a computer, unless the padding is compressed completely (i.e., compressed to half the thickness of the foam pad). In order to provide a sufficient level of protection, the foam thickness is in many instances as much as three (3) inches in thickness.

Other manufacturers attempt to provide protection by using hard shell cases, which can be made thinner, but still may require foam padding inside to provide sufficient protection. Overall, such cases are less economical than those that rely solely on foam reinforcement.

Still other manufacturers have attempted to create suspension systems for the computers within cases, which add bulk, complexity and cost to the manufacture of the case.

It is desired to produce a computer carrying case that provide a high level of protection from impacts, that is streamlined, and economical to manufacture.

SUMMARY

The present disclosure is directed, in one embodiment, to a protective insert for a protective case. The protective insert comprises a longitudinal body comprising opposing front and back surfaces and at least one longitudinal protective element disposed at the front surface. The protective element can include an upper surface and a sidewall extending downwardly from the upper surface. A plurality of channels can be defined in the at least one protective element, and each of the channels can include a sidewall extending downwardly from the upper surface. A plurality of cushioning regions can be defined by the plurality of perpendicular channels, disposed in the at least one protective element.

The present disclosure is directed, in another embodiment, to a protective insert that includes a longitudinal body with opposing front and back surfaces. The body can comprise a base layer, an intermediate layer of a rate dependent material, and a surface layer. The body can comprise at least one longitudinal protective element, and the protective element can comprise a plurality of spaced apart channels. The spaced apart channels can be disposed about perpendicular to the protective element. The rate dependent material can be encapsulated by the base layer and the surface layer.

In certain embodiments, the protective insert can comprise at least two spaced apart longitudinal protective elements.

In certain embodiments, the insert can comprise a flange, and the rate dependent material in the flange can also be encapsulated by the base layer and the outer layer.

In certain embodiments, the protective insert can be disposed in a case. The case can comprise opposing walls and a sidewall disposed between the opposing walls. The insert can be disposed in the case adjacent to the base, permanently or releasably and temporarily.

BRIEF DESCRIPTION OF THE DRAWINGS

The foregoing and other features and advantages will be apparent from the following more particular description of exemplary embodiments of the disclosure, as illustrated in the accompanying drawings, in which like reference characters refer to the same parts throughout the different views. The drawings are not necessarily to scale, emphasis instead being placed upon illustrating the principles of the disclosure.

DETAILED DESCRIPTION OF EXEMPLARY EMBODIMENTS

Figure 1:
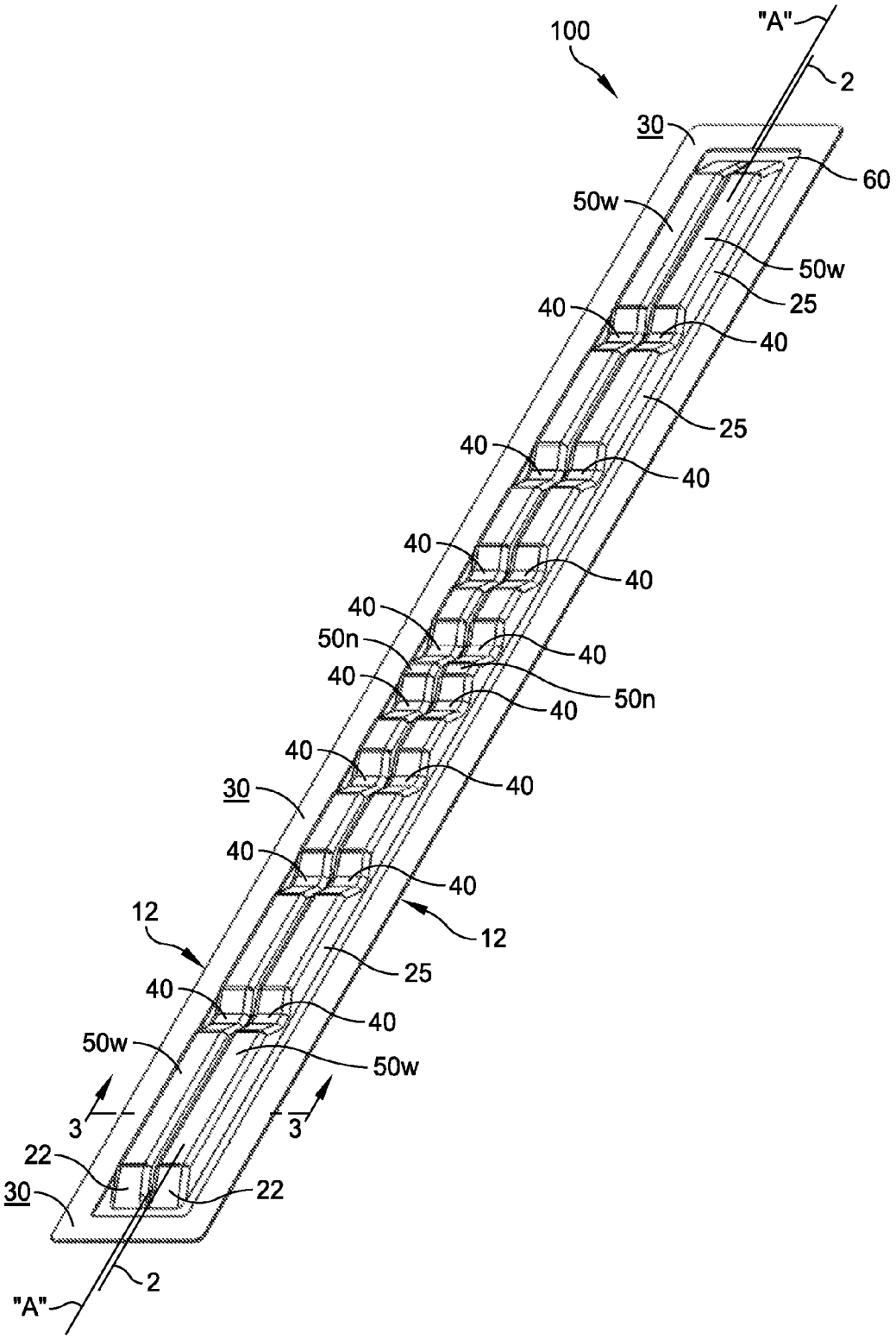
FIG. 1 is a front perspective view of one exemplary protective insert for according to the present disclosure.
Figure 2:
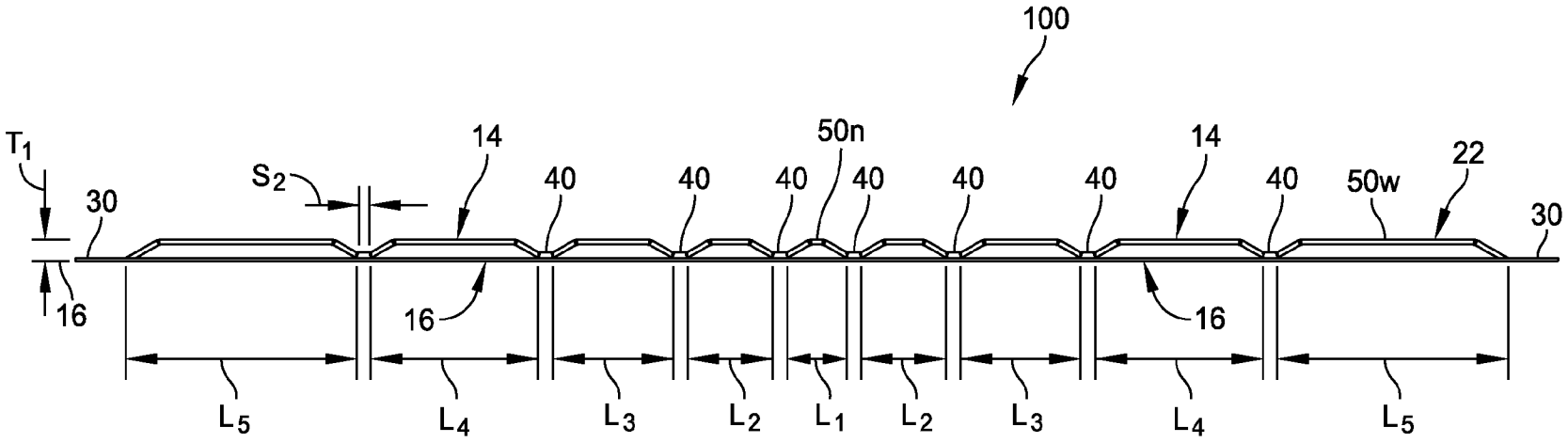
FIG. 2 is a side view of the protective insert shown in FIG. 1, through line 2-2.
Figure 3:
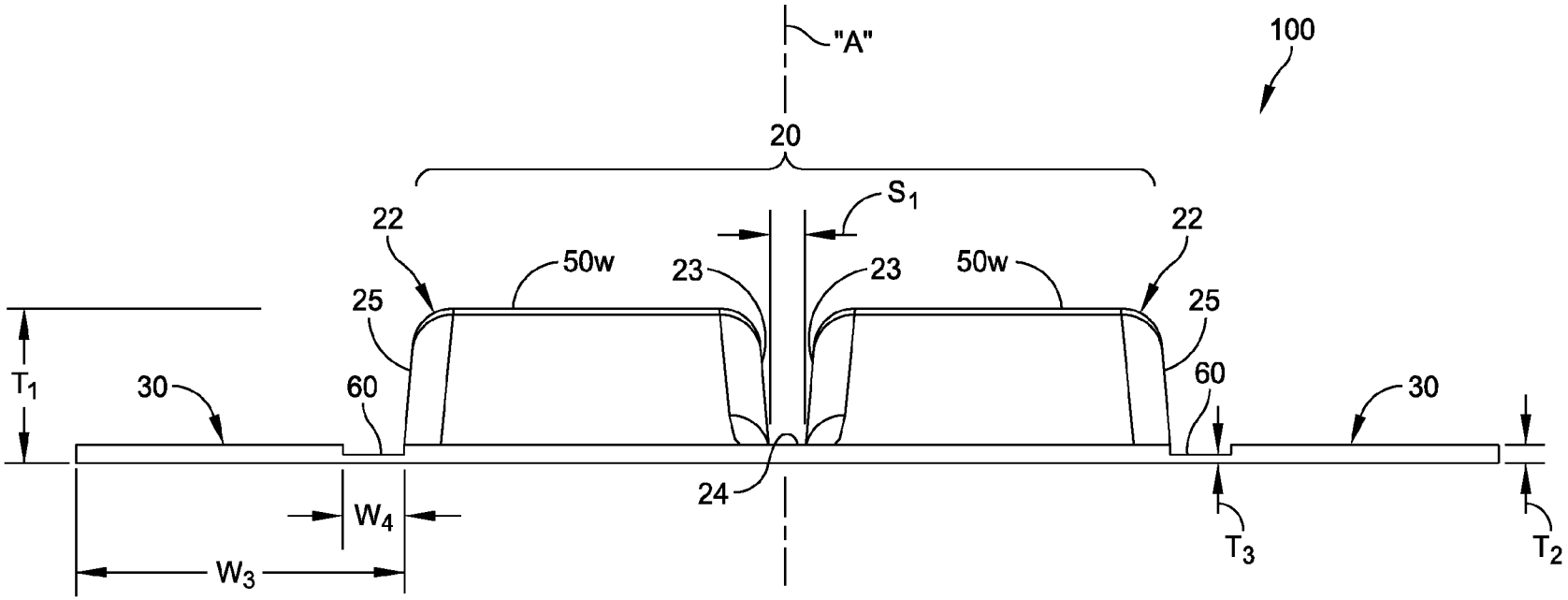
FIG. 3 is an end view of the protective insert shown in FIG. 1, through line 3-3.
Figure 4:
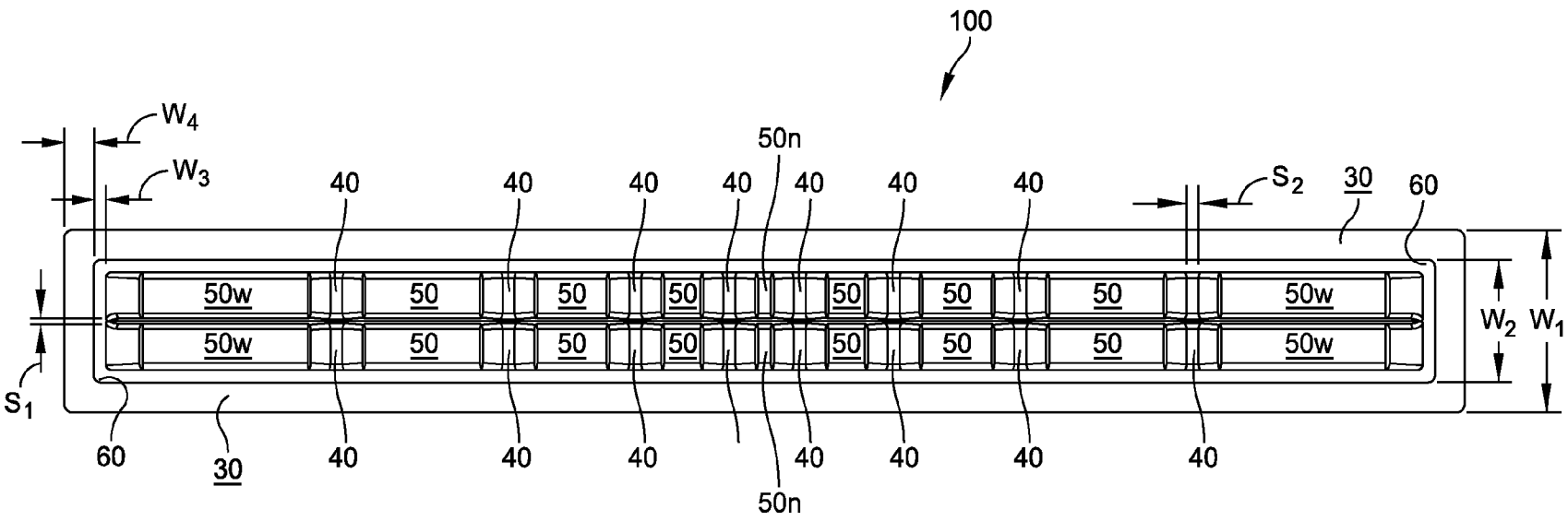
FIG. 4 is a top view of the protective insert shown in FIG. 1.
Figure 5:
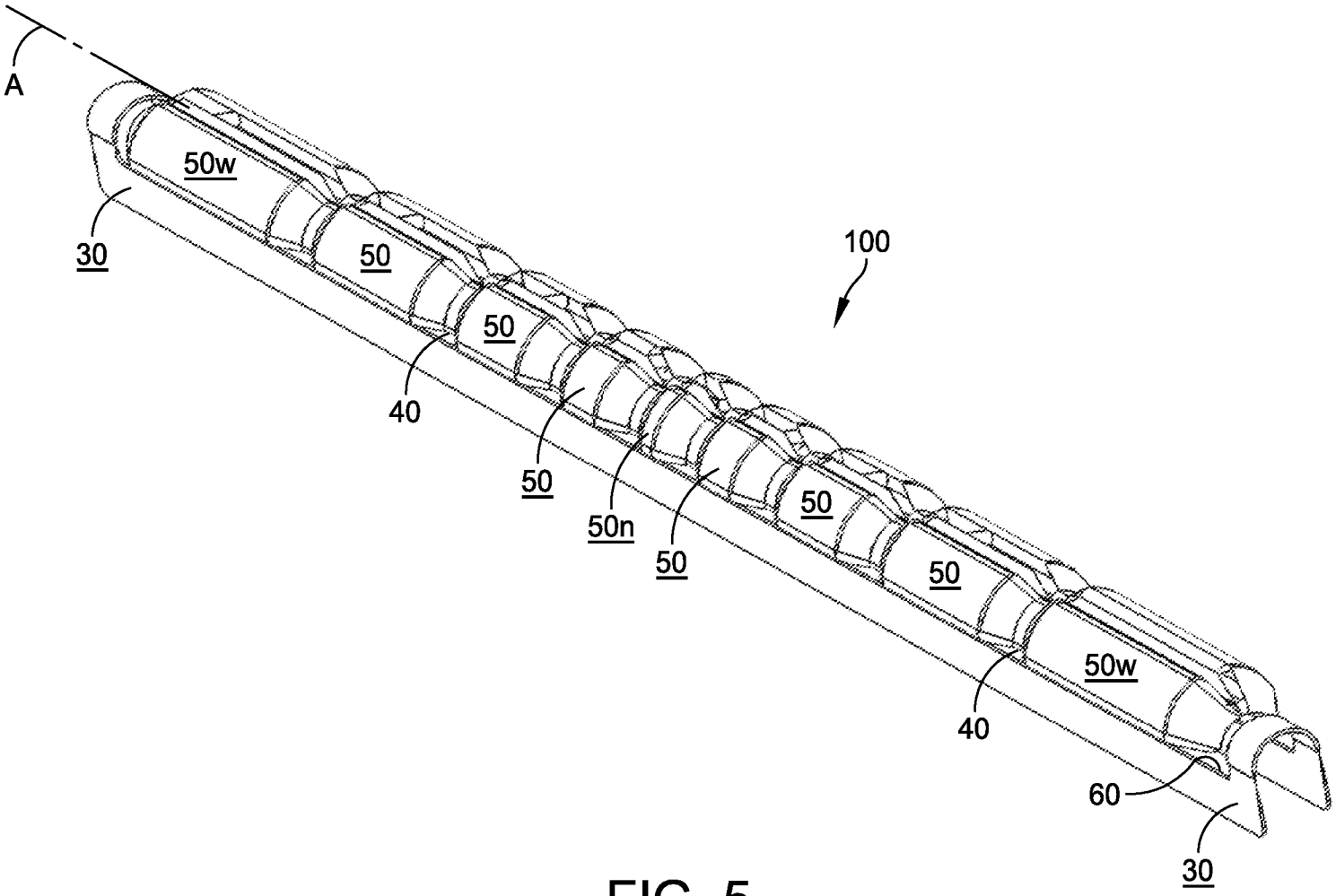
FIG. 5 is a front perspective view of the insert shown in FIG. 1, folded along the longitudinal axis, with the back surface folded inwardly.
Figure 6:
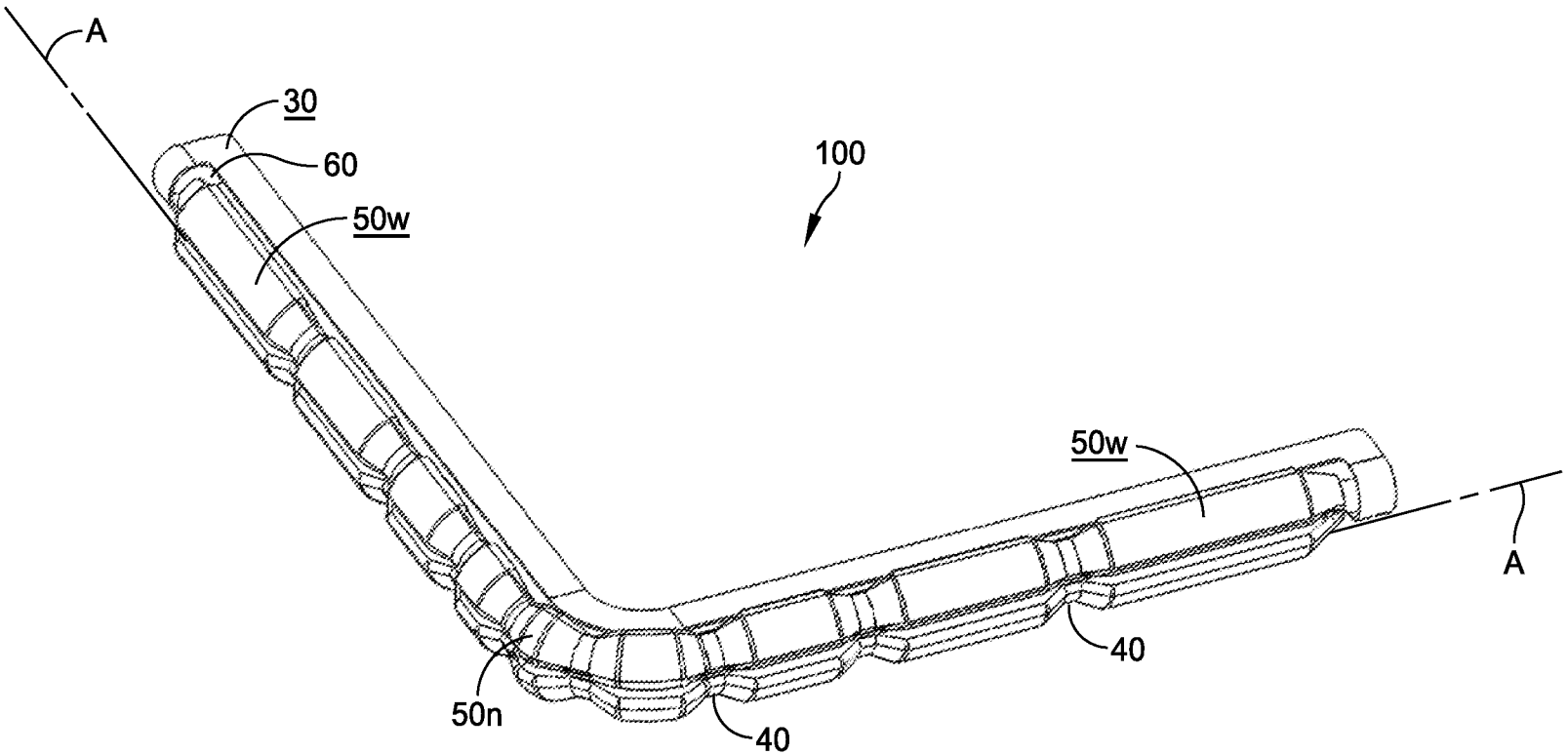
FIGS. 6 and 7 are perspective views of the protective insert shown in FIG. 5, further folded perpendicularly to the longitudinal axis.
Figure 7:
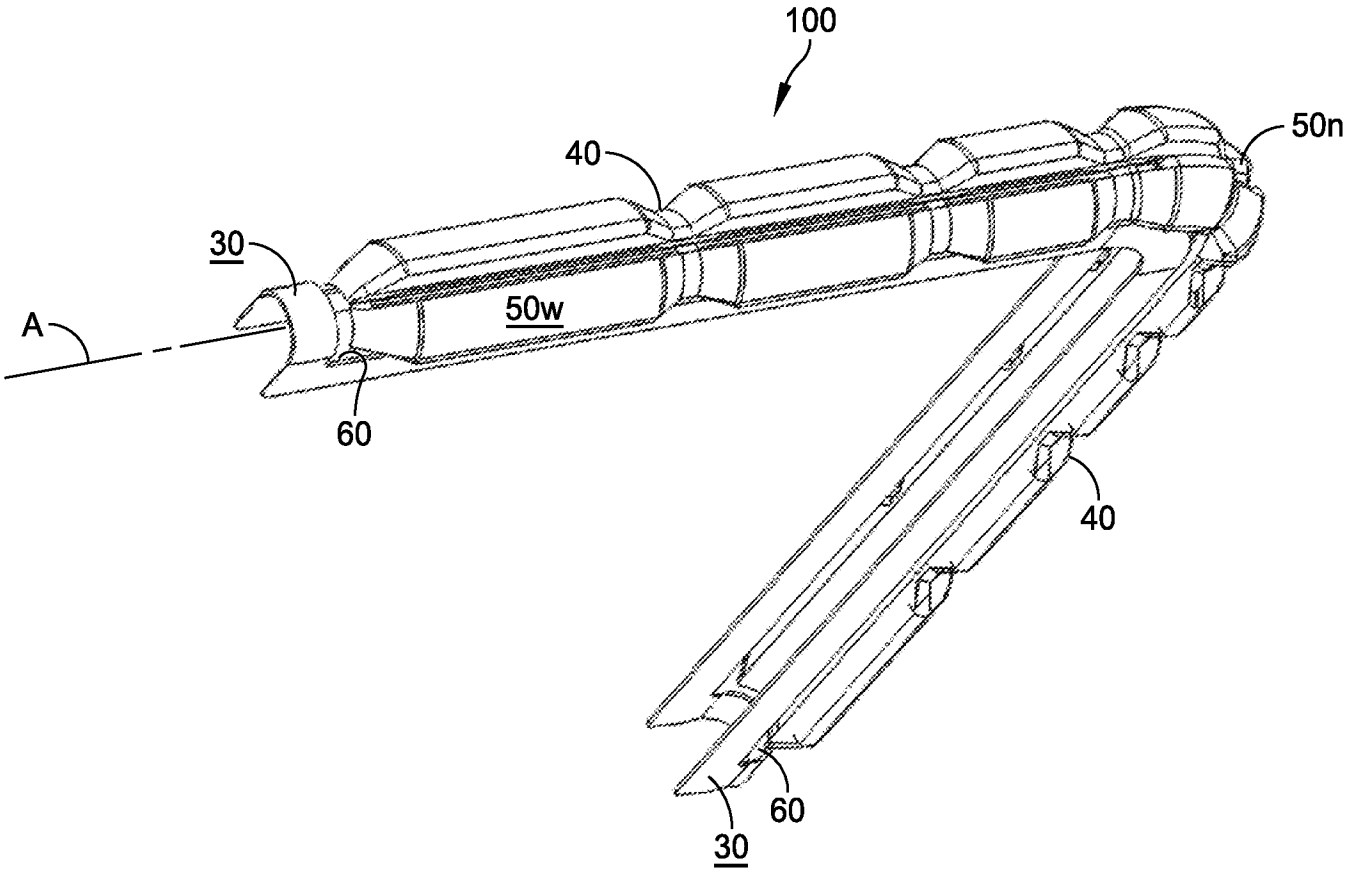

The present disclosure is directed to a protective insert that can be inserted into a variety of items, such as computer carrying cases, to provide improved impact protection for a variety of items carried therein, particularly for the edges of items. The protective inserts also can be integrated into the cases.

One aspect of the disclosure is a flexible protective insert, which can be disposed in and/or attached to the interior and/or exterior of existing cases, and is capable of accommodating a range of case shapes and sizes, depending on its construction. The protective inserts can be designed and used for any type of case for an item that may need protection, such as electronic devices, musical instruments, wine and liquor bottles, crystal, and the like.

Some embodiments of the protective inserts comprise a film of polyester polyurethane, which has unexpectedly improved the performance of the present cases in certain harsh environments, such as during repeated commercial laundering, and it is thought that the unexpected performance is due to the continuous bonding of the materials, particularly at the perimeter of the protective inserts, and to the encapsulation of the intermediate layer, as will be discussed in detail below. As a result, the cases are hygienic, and are capable of withstanding the high temperatures and caustic chemicals used in commercial-grade laundering.

The protective inserts also can be used to make protective cases that provide improved impact protection, lighter weight, reduced bulk, improved aesthetics, reduced manufacturing costs, improved fit, and less abrasion to the contained article.

Protective inserts according to the present disclosure can comprise at least one protective element 20. FIGS. 1-7, when taken together, show one exemplary protective insert 100, comprising a protective element 20 and a flange 30 extending outwardly from the protective element 20 to define an outer edge 12. In the present embodiment, the protective element 20 comprises two longitudinal sub-elements 22, but it should be understood that the protective element may comprise multiple sub-elements, as needed or desired.

The protective insert 100 comprises a contoured upper surface 14 and a back surface 16, which are common to both the protective element 20 and the flange 30, and a thickness $T_1$. One suitable thickness range $T_1$ for a protective insert that can be used for a carrying case for electronic devices ranges from about 1/16 to about 1/2 inch, more particularly about 1/8 to about 3/8 inch. It should be understood that the thickness $T_1$ may be increased or decreased from the foregoing range, as needed or desired for the intended application.

The upper surface 14 of protective element 20 may be contoured using a variety of geometries, including planar surfaces, curved surfaces, and combinations of planar and curved surfaces. Similarly, the back surface is illustrated as planar, but it should be understood that it also may be contoured, as needed or desired, and that both the upper and lower surfaces may contoured, as needed or desired.

The protective insert 100 comprises a width "$W_1$" that may vary as needed or desired, and a longitudinal axis "A," both of which are common to the protective element 20. Similarly, the protective element 20 comprises a width "$W_2$" and flange 30 comprises a width "$W_3$," both of which are narrower than width $W_1$, and both of which may vary, as needed or desired, individually or in combination. A suitable width $W_1$ for carrying case for electronic devices ranges from 1/4 inch to abut 3 inches, more particularly about 1/2 inch to about 2 inches, more particularly still about 3/4 inch to about 1 inch.

In the present embodiment, the two longitudinal sub-elements 22 are disposed parallel to axis A. Sub-elements 22 are identical in the present embodiment, and are spaced apart from each other by a spacer region 24, which has a spacing width "$S_1$" that can vary as needed or desired. A spacer region width $S_1$ for carrying cases for electronic devices ranges from about 1/32 inch to about 1/2 inch.

In the present embodiment, the sub-elements 22 comprise an upper surface 14 and sidewalls 23, 25 that extend downwardly from the upper surface 14. In the present embodiment, the sidewalls 23,25 are about perpendicular to the back surface 16. The spacer region 24 allows the insert 200 to be folded longitudinally along axis A.

A plurality of channels 40 may be defined in the protective element or sub-elements 22, to define a plurality of cushioning regions 50. Channels 40 comprise a spacing width "$S_2$" that can vary as needed or desired. In the present embodiment, the channels 40 are disposed about perpendicularly to axis A, but it should be understood that the channels 40 may be disposed in other orientations or configurations. The width, depth, orientation and position of the channels 24, 40 may be varied, depending on a number of factors including, but not limited to, the desired length of the cushioning regions 50, the desired amount of flexibility for the insert, and the like. The channels 40 allow the insert 200 to be folded perpendicularly to axis A. Cushioning regions 50 comprise interior sidewalls 51, 52 that may be perpendicular to the base, or disposed at an angle β, which may be varied as needed or desired, and increasing angle β increases the amount of flexibility of the insert along channels 24.

In the present embodiment, the cushioning regions 50 vary in length from $L_1$-$L_5$, such that the narrowest cushioning region **50*n* is disposed at the center of the sub-elements 22 with a length $L_5$, and the widest cushioning regions 50*w* are disposed at opposite ends of sub-elements 22 with a length $L_5$. The thickness and length of the cushioning regions 50 may be varied, depending on a number of factors including, but not limited to, the desired amount of flexibility for the insert, and the like. In the present embodiment, the length of the cushioning regions 50** varies according to a selected ratio of 1:1.4, but those of ordinary skill in the art will recognize that any ratio may be selected, as desired, and that it is not necessary for the length to vary.

Flange 30 comprises a thickness $T_2$, which is less than the thickness $T_1$ of insert 100, and which is sufficient to allow the insert to be attached to items such as clothing along the flange area using a variety of techniques, such as by sewing, gluing, bonding, and the like.

Flange 30 also may comprise an optional perimeter channel 60 spaced apart from the outer edge 12. Perimeter channel 60 can comprise a width "$W_4$" which may vary, as desired. Perimeter channel 60 comprises a thickness $T_3$ which is less than the thickness $T_2$ of flange 30, which may be useful when attaching the insert to items such as clothing along the perimeter channel 60 area using a variety of techniques, such as by sewing, gluing, bonding, and the like.

FIGS. 8-15, when taken together, show another exemplary embodiment of a flexible, protective insert 200 according to the present disclosure, which comprises common features with respect to insert 100. In the present embodiment, the outer sidewalls 25 are about perpendicular to the back surface 16, and inner sidewalls 23 slope downwardly toward axis A, to define an angle θ with respect to a axis "B" that is perpendicular to axis A. The angled sidewalls 23, together with the flexible channel 24, allow the insert 200 to be folded longitudinally along axis A, to bring the sidewalls 23 adjacent to each other. Angle θ may be varied as needed or desired, and increasing angle θ increases the amount of flexibility of the insert along axis A.

All of the features disclosed above in either of the foregoing embodiments are combinable and modifiable, as needed or desired. For example, the total thickness of the protective inserts, the thickness of the protective elements, the spacing between the protective elements, the width of the channel separating the sub-elements, the width of the flange, the width of the perimeter flange, and the like, all can be varied individually or in combination to achieve a variety of different functional characteristics.

Figure 8:
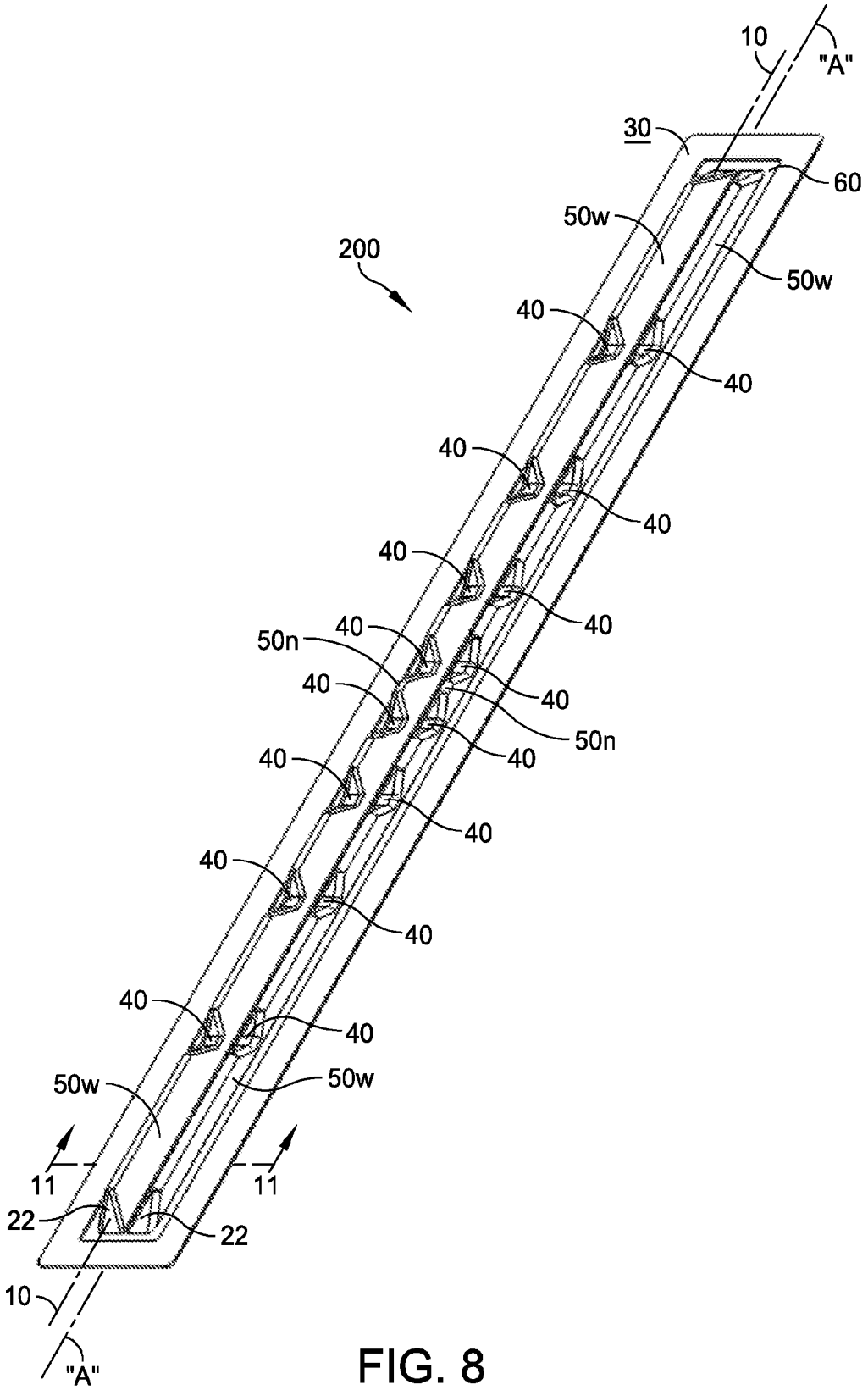
FIG. 8 is a front perspective view of another exemplary protective insert for according to the present disclosure.
Figure 9:
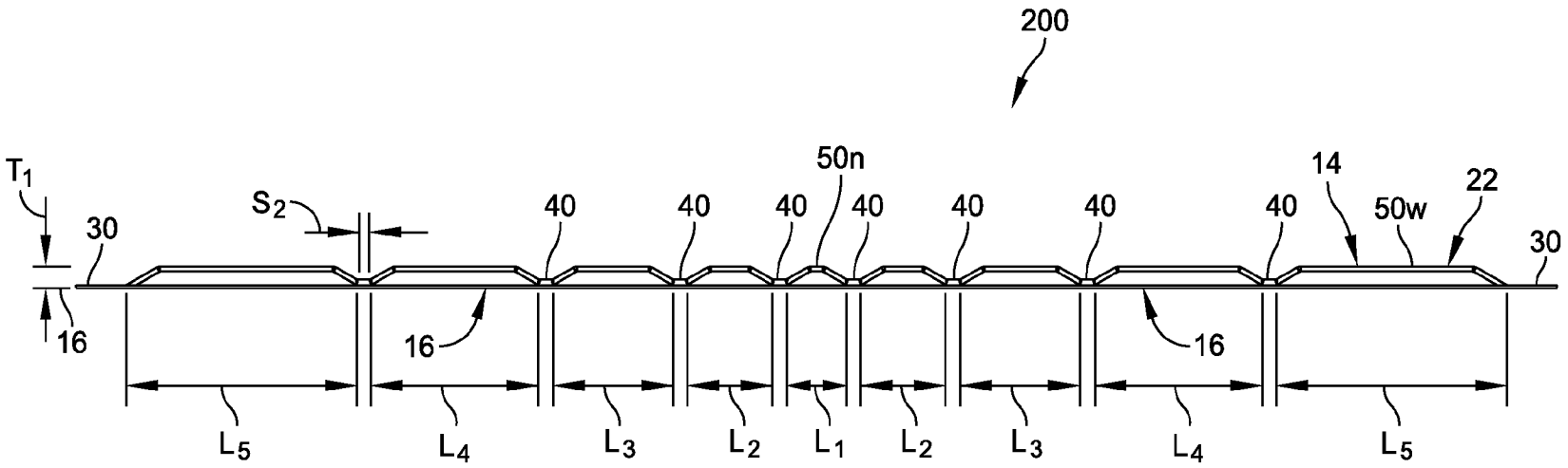
FIG. 9 is a side view of the protective insert shown in FIG. 8, through line 9-9.
Figure 10:
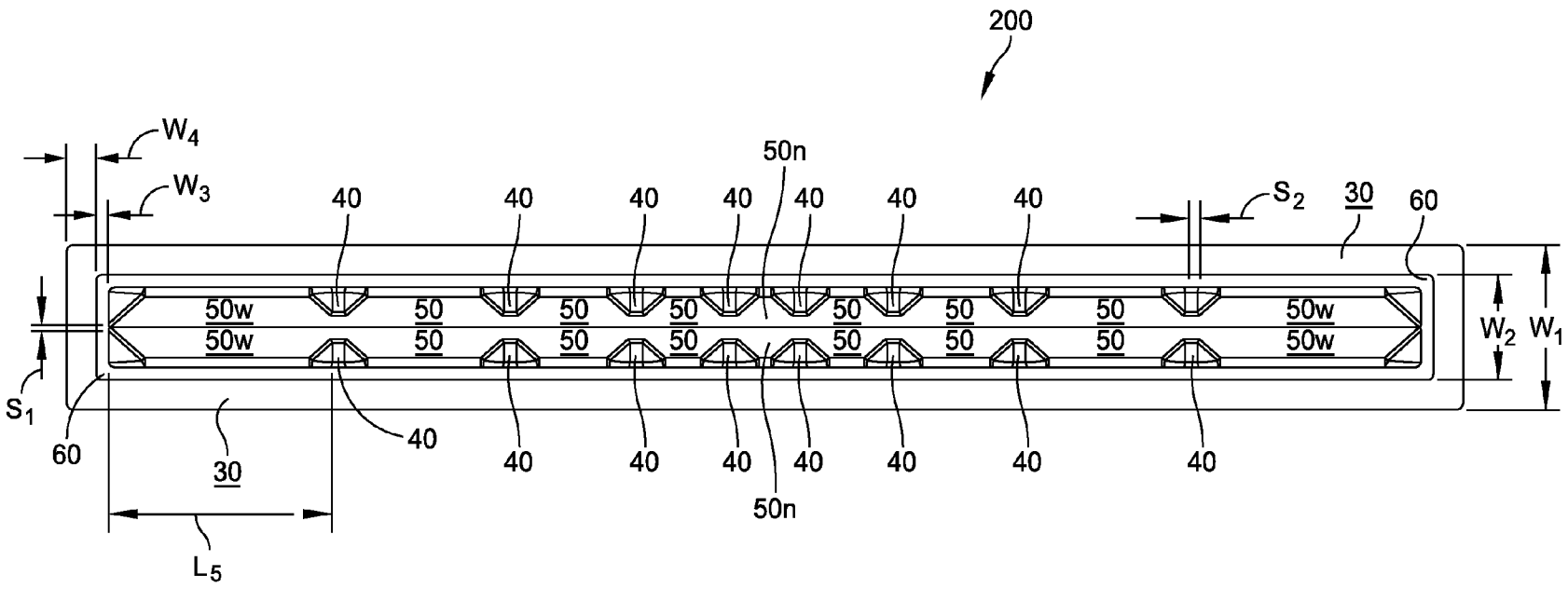
FIG. 10 is a top view of the protective insert shown in FIG. 8.
Figure 11:
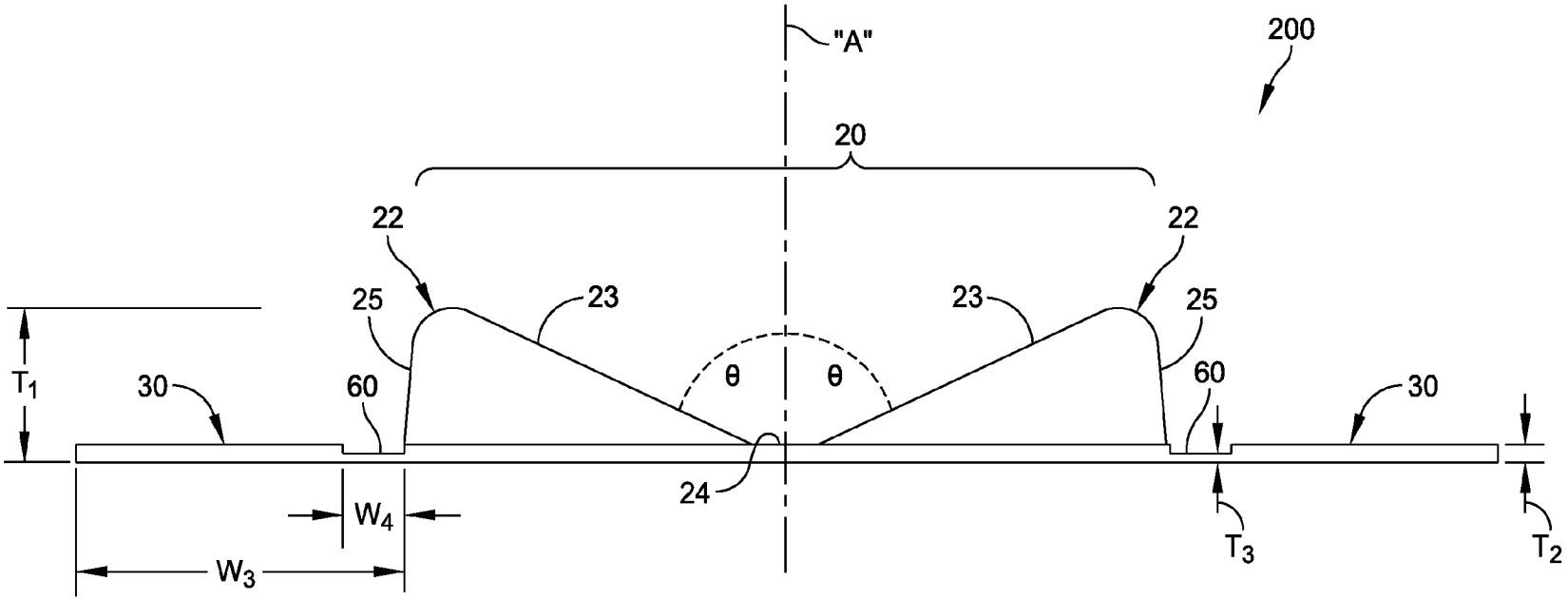
FIG. 11 is an end view of the protective insert shown in FIG. 8, through line 11-11.
Figure 12:
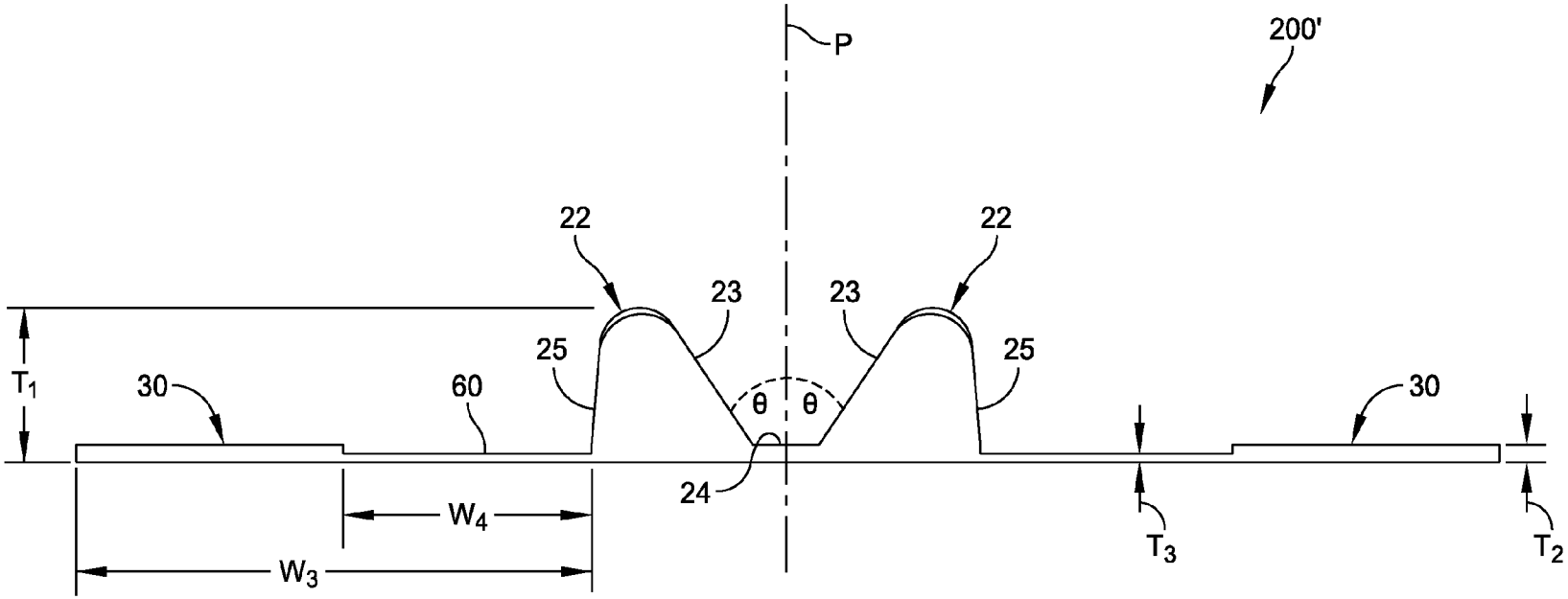
FIG. 12 is an end view of an alternative embodiment of the protective insert shown in FIG. 8, through line 12-12.
Figure 13:
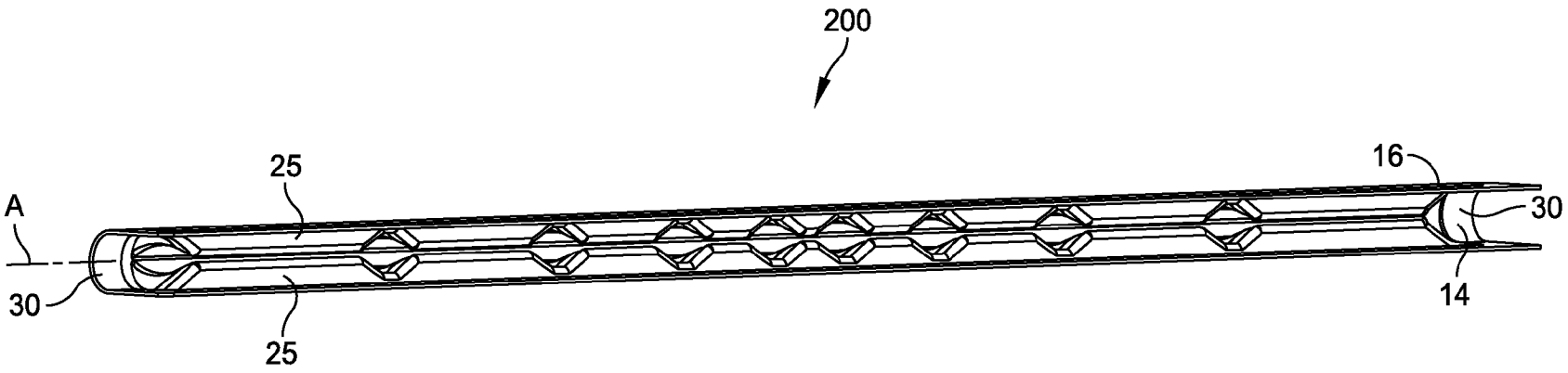
FIG. 13 is a perspective view of the insert shown in FIG. 8, folded along the longitudinal axis A.
Figure 14:
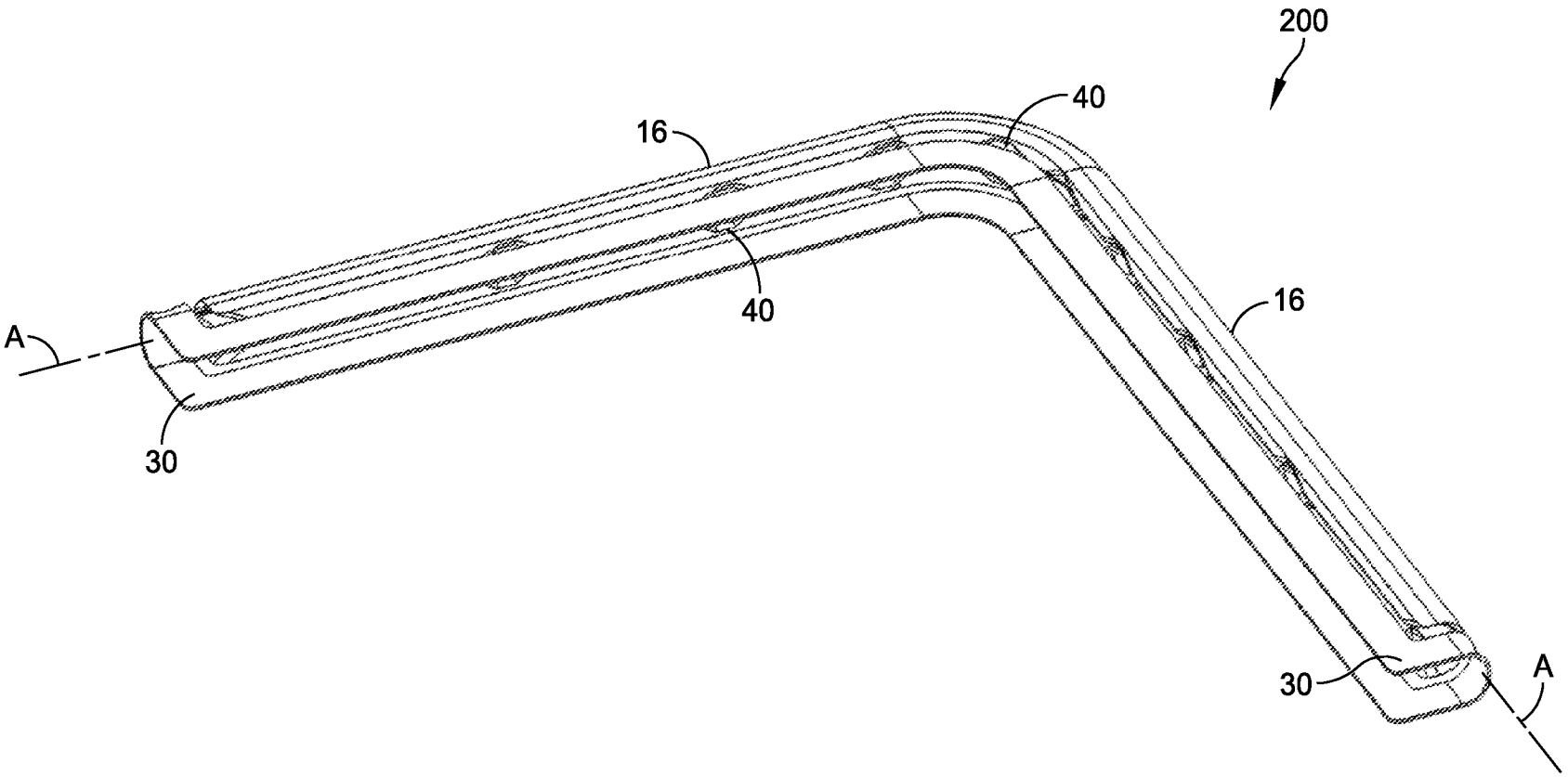
FIG. 14 is a perspective view of the folder protective insert shown in FIG. 13, folded perpendicularly to the longitudinal axis.
Figure 15:
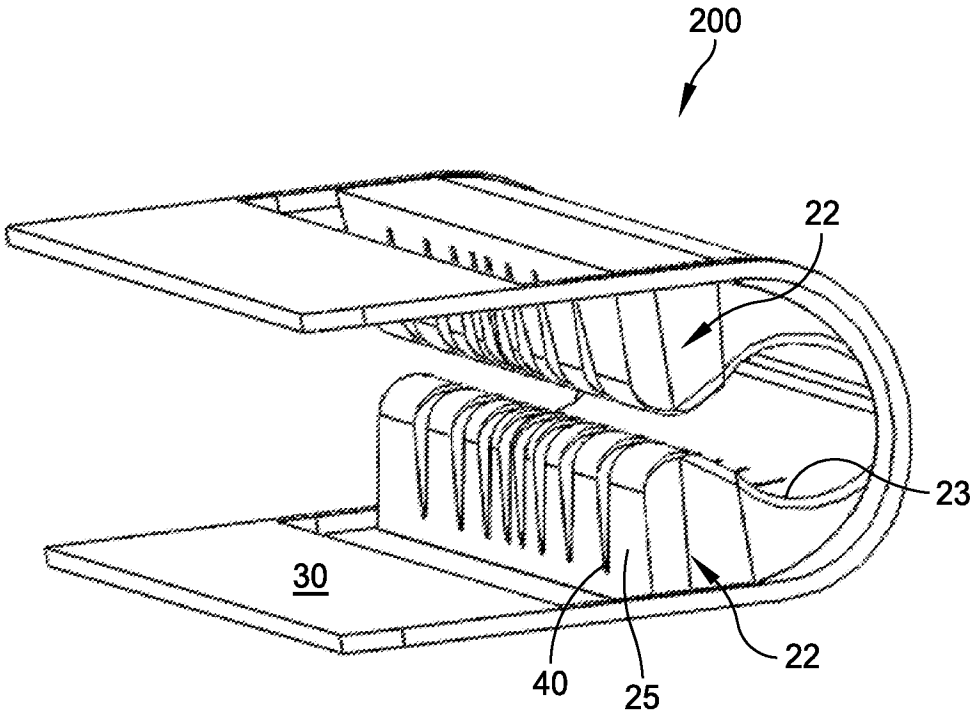
FIG. 15 is a perspective view of a section of the insert shown in FIG. 13, showing the relative positions of the cushioning regions when the insert is in a folded configuration.
Figure 16:
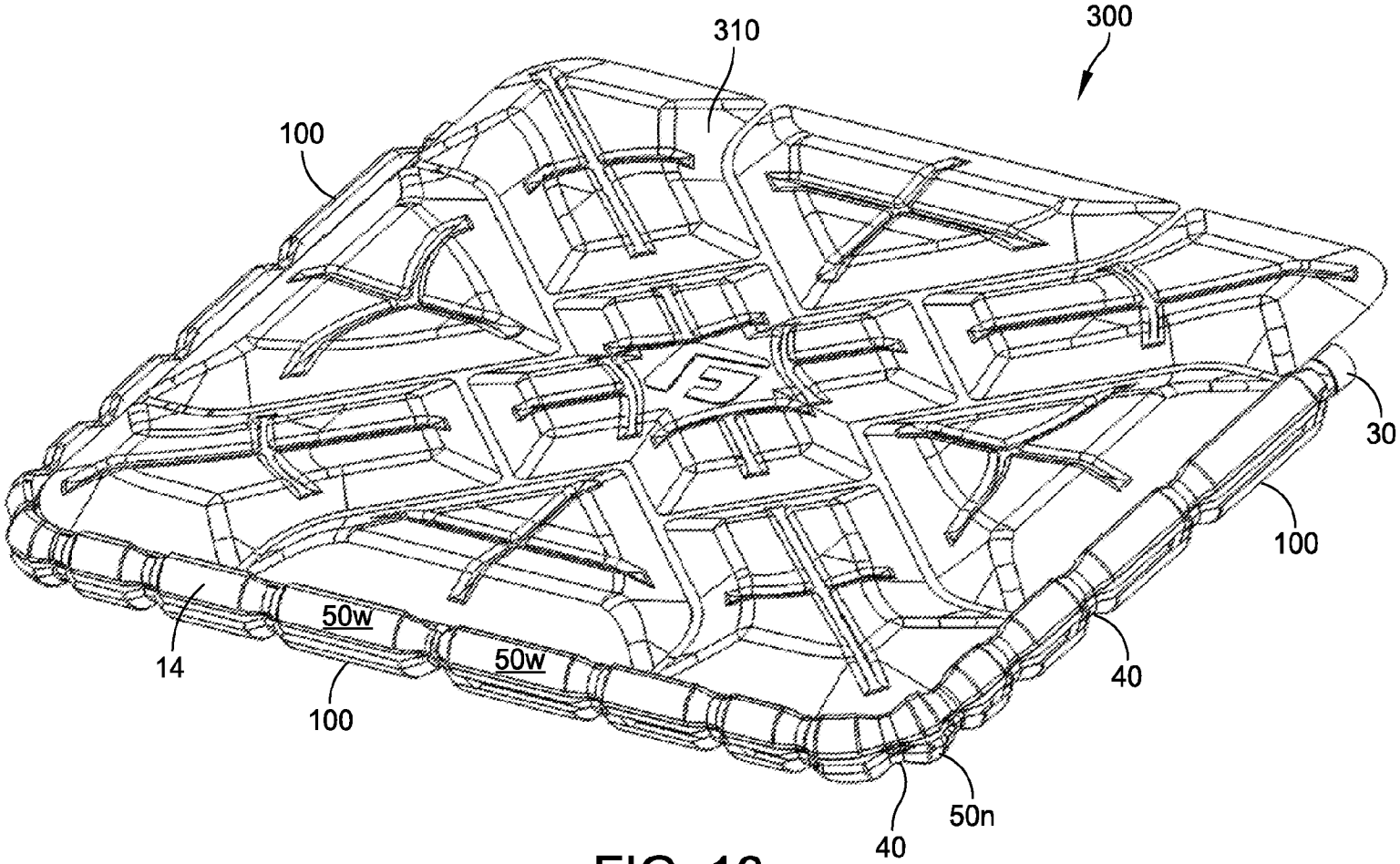
FIG. 16 is a perspective view of one exemplary embodiment of an envelope-style protective case that includes protective sidewalls and a gusset formed by the protective insert shown in FIGS. 1-7.
Figure 17:
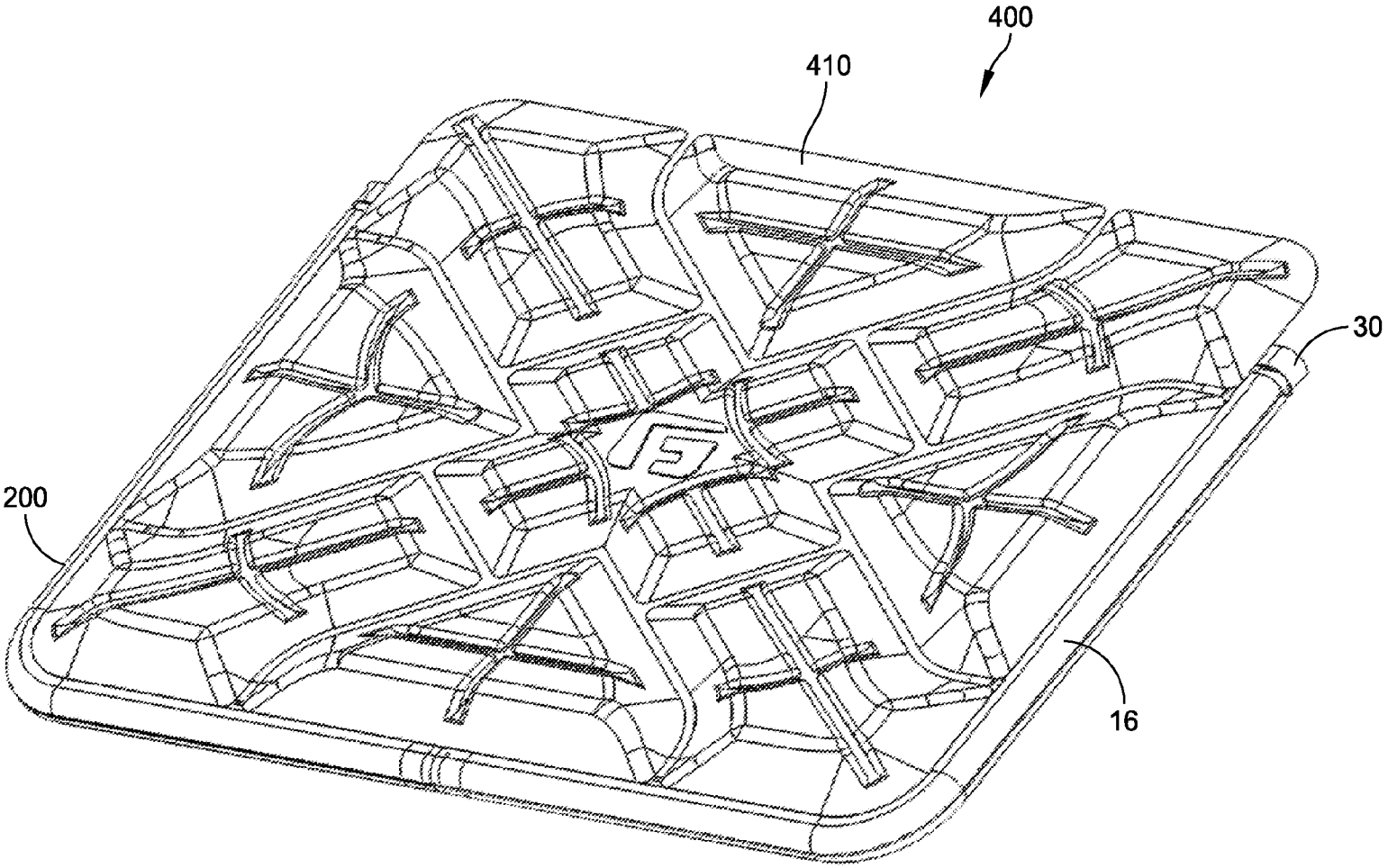
FIG. 17 is a perspective view of another exemplary embodiment of an envelope-style case that includes protective sidewalls and a gusset formed by the protective insert shown in FIGS. 8-15.
Figure 18:
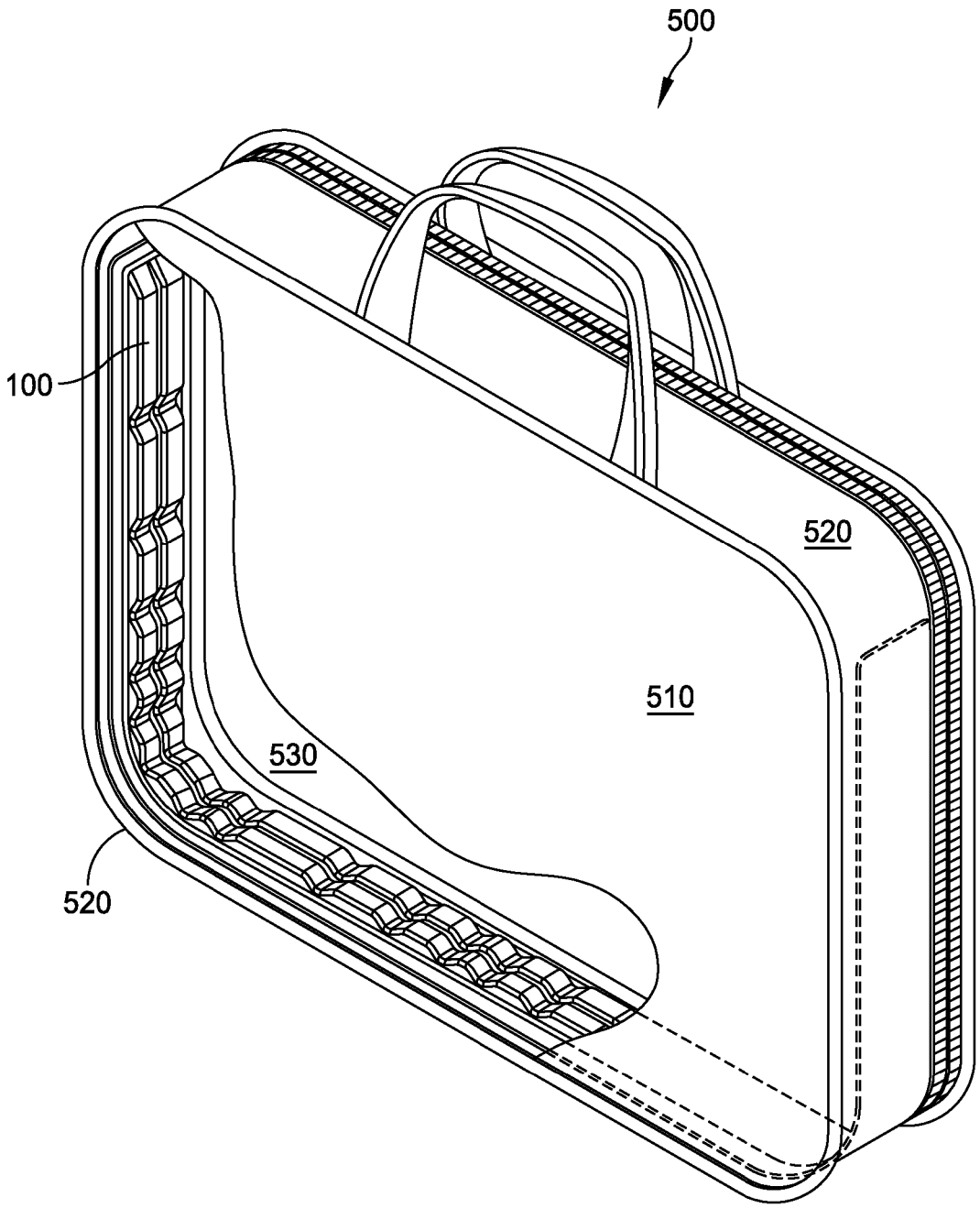
FIG. 18 is a perspective view of another exemplary embodiment of an enclosed carrying case with handles, that includes a gusset formed by the protective insert shown in FIGS. 1-7.

Another aspect of the present disclosure involves protective cases with gussets formed using the foregoing protective inserts. FIGS. 8 and 18 show two different embodiments of exemplary protective cases 300, 400 according to the present disclosure, each of which includes a pair of opposed structural walls 310, 410, which are mirror images thereof, and a gusset disposed between the opposed walls to define a principal compartment (not illustrated) for receiving the item to be protected.

The gusset of case 300 is formed from protective insert 100, described above. In the present embodiment, protective insert 100 is disposed such that the protective element 20 faces outwardly, and the base 16 forms a surface of the principal compartment, but it should be understood that the orientation may be reversed. Channel 24 allows the gusset to open outwardly along axis A, and channels 40 allow the protective insert 100 to ease and open around the corners of the case 300. The protective elements 50 are disposed externally, and provide improved edge protection from impact, which is typically where the greatest forces are reached during impacts.

The gusset of case 400 is formed from protective insert 200, as described above. In the present embodiment, protective insert 200 is disposed such that the base 16 faces outwardly, and the protective element 20 forms a surface of the principal compartment, but it should be understood that the orientation may be reversed. Channel 24 allows the protective insert 100 to fold inwardly along axis A, and channels 40 provide each for the protective insert 100 to squeeze together in the corners of the case 400, without adding bulk. The folding of the protective elements along axis A and channels 40 provides an internal receiving channel (not illustrated) or suspension system for an item disposed in the principal compartment, providing improved edge protection from impact.

In both of the foregoing cases 300,400, the protective inserts 100,200 are connected to the sidewalls by stitching (not illustrated) through flange 30, in the flange spacer region 60, but it should be understood that a variety of connection techniques may be used, such as gluing, welding, heat sealing, and the like.

In both of the foregoing cases 300,400, the opposed structural walls 310, 410 may be reversed.

Those of ordinary skill in the art will recognize that it is not necessary for the cases to have rectangular shape, and that they may have any shape and/or configuration. Those of ordinary skill in the art will recognize that the case may comprise a closure, and that a variety of closures may be used including, but not limited to, zippers, including waterproof, air resistant and plastic zippers (e.g., Ziploc-style zippers); pillow flap type enclosures; envelope-style enclosures; hook and eye tape; magnets; clips; and the like. Those of ordinary skill in the art will recognize that any number of protective inserts may be used to form the gusset, and that the protective inserts may have any shape, size and/or configuration, as desired.

Figure 19:
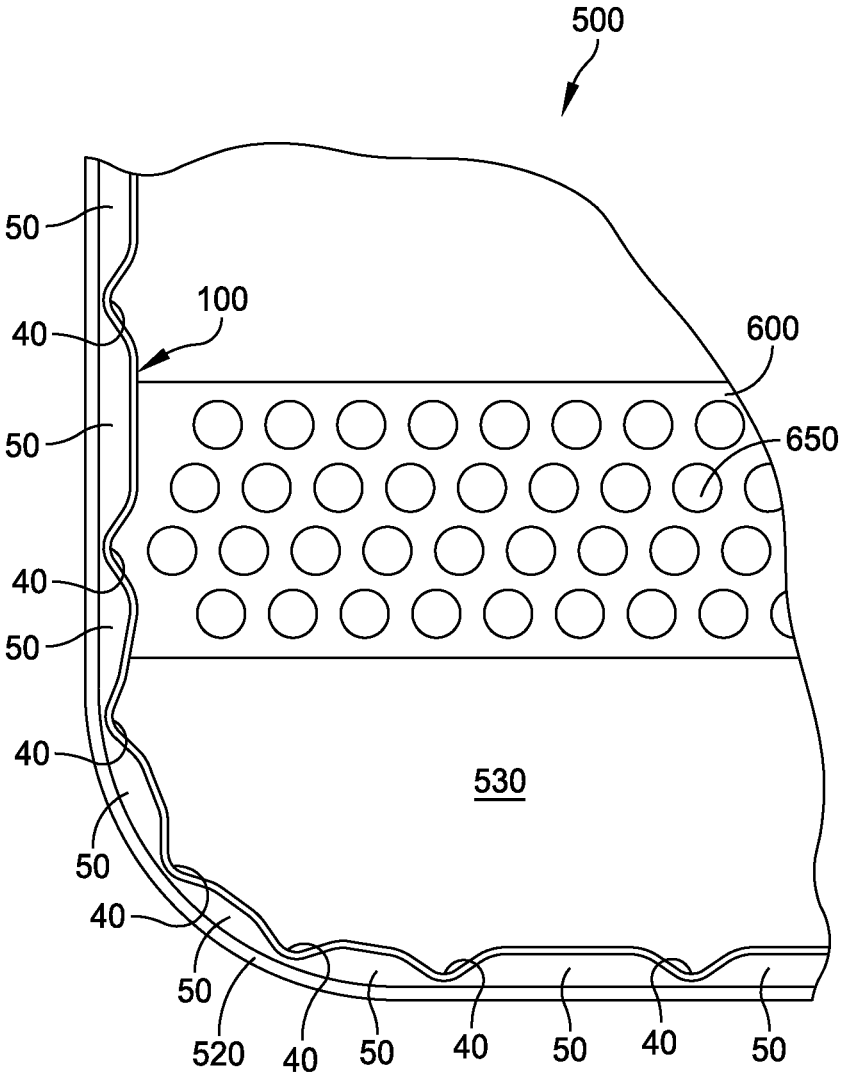
FIG. 19 is a side view of the principal compartment of the carrying case shown in FIG. 18.

In another aspect of the present disclosure, the protective inserts according to the present disclosure can be used to retrofit cases that have little or no protection. FIGS. 18 and 19 show an exemplary embodiment of a retrofitted protective case 500 according to the present disclosure, which includes a flexible, rectangular case body defined by a pair of opposed front and back walls 510, which are mirror images thereof, and a sidewall 520 disposed between the opposed walls 510 to define a principal compartment 530 for receiving an item to be protected, with a zipper closure 520 extending partially around the case body. A protective insert 100 is disposed in the principal compartment 520 such that the protective elements 50 are disposed internally. Channels 40 allow the insert 100 to fold into the corners, without adding bulk to the interior of the case. The protective insert can also be releasably disposed in the principal compartment 500 between the opposed walls to define a shock absorbing cradle which can be removed so that the carrying case can be used for other purposes. If desired, the protective insert also may be releasably attached to the sidewall 520 in the principal compartment using a variety of attachment devices and/or techniques such as a pressure sensitive adhesive, Velcro, snaps, rivets, and the like. Similarly, the protective insert also may be permanently affixed to the sidewall 520 in the principal compartment using a variety of techniques such as a stitching, gluing, welding, and the like.

Optionally, the opposed front and back walls 510 also may be retrofitted with a protective insert 600, as shown in FIG. 19. Protective insert 600 is an example of a protective insert comprising multiple rows comprising a plurality of circular cushioning members 650. The protective insert 600 is disposed on the back wall of the principal compartment, attached permanently or temporarily using similar techniques as described above.

Those of ordinary skill in the art will recognize that it is not necessary for the cases to have rectangular shape, and that they may have any shape and/or configuration. Those of ordinary skill in the art will recognize that a variety of closures maybe used in the cases including, but not limited to, zippers, including waterproof, air resistant and plastic zippers; pillow flap type enclosures; envelope-style enclosures; hook and eye tape; magnets; clips; and the like. Those of ordinary skill in the art will recognize that any number of protective inserts may be used to form the gusset, and that the protective inserts may have any shape, size and/or configuration, as desired.

Optionally, any of the cases disclosed above can comprise a protective binding (not illustrated) attached to the outer edge at the closure. The binding can comprise the same material as used for the protective inserts, particularly with ballistic fabric, which provides a rugged edge. The binding can be disposed such that the ballistic material is inverted, so protective insert is internal on the edge, and vice versa.

Optionally, any of the cases disclosed above can comprise a plurality of access ports to provide access to various functional keys on the device and/or to external devices, such as battery chargers, and the like. Those of ordinary skill in the art will recognize that that any number of access ports may be included, that the access port(s) may be positioned anywhere on the case body, and that the access ports may have any shape, size and/or configuration, as desired, and can be disposed in any location, as desired, to correspond with the location of such features as found on commercial electronic devices, or any device to be protected.

Optionally, any of the cases disclosed above can comprise a liner (not illustrated) attached to the interior of one or both of the front and back sides of the case.

Optionally, any of the cases disclosed above can comprise a variety of accessories (not illustrated), such as pockets for paper and/or writing instruments, handles, straps, zippers, straps or other devices, including devices that allow the case to be attached to other items, such as backpacks, luggage, clothing, jackets, and the like, or integrated into the foregoing items as a pocket or sleeve, and the like. Those of ordinary skill in the art will recognize that that any number of accessories may be included, that the accessories may be positioned anywhere in or on the case body, and that the accessories may have any shape, size and/or configuration, as desired.

Optionally, any of the cases disclosed above can comprise a structural insert (not illustrated) disposed in the case body to provide some rigidity to the side panels. The structural insert can comprise the same material as used for the protective inserts, or can comprise a rigid material. When the cases comprise a liner, a structural insert can be disposed between the liner and the case body. Optionally, the rigid material in the case may be designed to be larger in length and width than the electronic device stored in the device case, to provide additional edge impact protection for the edges of the device.

The protective inserts can comprise an optional base layer, and optional outer layer, or optionally both base and outer layers. In addition, an additional layer or layers of materials can be disposed adjacent to, including bonded to, the surface layer for further improvements in durability and/or aesthetics.

When the optional inner and outer layers are used, the material described above becomes an intermediate layer disposed between the inner and outer layers, such that the intermediate layer may be encapsulated, and optionally bonded to the base and/or outer layers, which improves performance of the protective inserts in high humidity and under harsh conditions, such as encountered in commercial laundering, cleaning procedures in medical environments, and the like.

The protective inserts, or intermediate layer of the protective insert, can comprise a variety of materials such as, but not limited to, polymeric materials, including foamed polymeric materials, composite materials, and the like.

The polymer material can comprise any rpolymeric material comprising sufficient structural integrity to be formed into predetermined shapes, and that is capable of withstanding the environment in which it is intended to be used, without substantial degradation. Examples of suitable polymeric materials include, but are not limited to, thermosetting polymeric materials, elastomeric polymeric materials, thermoplastic materials, including thermoplastic elastomeric materials, composites thereof, foams thereof, and combinations comprising at least one of the foregoing. Some possible polymeric materials include, but are not limited to, polyurethane, silicone, and/or the like, and combinations comprising at least one of the foregoing materials.

In one exemplary embodiment, the material can comprise a dilatant or shear thickening material, such as rate dependent materials. In one exemplary embodiment, the material can comprise d3O. In one exemplary embodiment, the material can comprise a material such as polyborosiloxane. In another exemplary embodiment, the material can comprise a rate dependent foam. For such applications, it can be desirable for the rate dependent foam to have a density ranging from about 5 to about 35 pounds per cubic foot (pcf), more particularly from about 10 to about 30 pcf, and more particularly still from about 15 to about 25 pcf. Suitable rate dependent foams are available from Rogers Corporation under the brand names PORON® and PORON XRD®, both of which are open cell, microcellular polyurethane foams.

Suitable outer layers can comprise any material capable of providing sufficient elasticity to prevent tearing and/or stretching when a force is applied thereto; sufficient structural integrity to be formed into predetermined shapes; and that is capable of withstanding the environment in which it is intended to be used (e.g., repetitive deformations such as twisting, bending, flexing, stretching, and the like), without substantial degradation. Examples of suitable extensible materials include, but are not limited to, thermoplastic elastomer ("TPE") film. Thermoplastic polyurethanes ("TPU"), both polyester and polyether, whether aromatic or aliphatic, have been found suitable. Suitable film thicknesses can ranges from about 1 milli-inch ("mil(s)") to about 15 mils, more particularly between about 2 mils to about 10 mils, and even more particularly from about 3 mils to about 7 mils. However, when increased durability is desired, film thicknesses may be increased to, for example, 10-60 mils, or more, limited only by the characteristics and performance of the film after molding.

One exemplary material is a polyester thermoplastic polyurethane ("TPU") made by Bayer and sold under the name PS5400. As noted above, polyester polyurethanes have been found to perform unexpectedly well during repeated commercial laundering, and it is thought that the unexpected performance is due to the bonding of the materials, particularly at the perimeter of the protective inserts, and to the encapsulation of the intermediate layer.

Those of ordinary skill in the art will recognize that a combination of the foregoing materials and techniques can be used to make protective cases for a variety of devices that need to be protected, while providing the capability to modify the width of the case by varying the width of the protective inserts and/or protective elements, to adapt to cases of varying sizes. The case and protective inserts also can withstand commercial laundering also applies to other dirty environments including, but not limited to, muddy areas, chemical exposure, hospitals, military, and the like. Those of ordinary skill in the art will also recognize that the foregoing these techniques can be modified and/or combined with other features to be used for protection of other items.

Construction of the foregoing cases comprises selecting a suitable material for the case body, selecting suitable dimensions for the case body, attaching one or more protective inserts to the case body to form the gusset, and forming or attaching the closure. The sheet of case body material can comprise dimensions larger than the item to be protected, in order to accommodate a seam allowance. Those of ordinary skill in the art will recognize that a variety of attachment methods may be used to attach the protective inserts to the case body to form the gusset including, but not limited to, stitching, gluing, welding of any kind, or a combination of the foregoing. In instances in which water resistance is desired, it may be more desirable to heat seal, glue and/or welding the seams and/or zipper together. In the foregoing embodiments, the protective inserts were attached to the case body by stitching through the case body and the perimeter channel 60, adjacent to the protective elements 50.

The size, shape, configuration, thickness and material composition of any of the protective inserts disclosed herein may be varied, depending on a number of factors including, but not limited to, desired amount of flexibility, the degree of bend required to wrap around corner or shaped device elements, the amount of impact protection desired, and the like. In addition, size, shape, configuration, thickness and material composition of the protective inserts may be varied, and more than one type of shape may be used in the protective inserts.

The case body and optional liner can comprise a variety of materials with different aesthetic and functional characteristics, and which can be varied as needed or desired for a particular application or design. Suitable materials for the case body and optional liner include, but are not limited to, synthetic and/or non-synthetic materials including, but not limited to, paper, fabric, metal, metallized plastic, plastic film, metal foil, and/or the like, as well as composites, laminates thereof, and/or combinations comprising at least one of the foregoing. Other suitable materials include, bur are not limited to, fabrics, leather, vinyl, composites, laminates thereof, and/or combinations comprising at least one of the foregoing. If fabric is used, it can be synthetic or non-synthetic, knit, woven, non-woven, laminates thereof, and combinations comprising at least one of the foregoing. Any of the foregoing materials can be laminated and/or can comprise a coating on one or both surfaces, to impart desirable functional or aesthetic characteristics, such as water repellency, and the like.

Examples of suitable non-extensible or low stretch materials from which the case body and optional liner may be made include, but are not limited to, nonwoven materials, including nonwoven fabrics, leather, woven materials, such as ballistic fabrics, and the like. Examples of ballistic materials include, but are not limited to, reinforced and un-reinforced polyester, nylon, rayon, polyamides (such as aramids and para-aramids), and the like, and combinations thereof. Examples may include Cordura, Kevlar, Twaron, Spectra, Zylon, ripstop weaves thereof, and combinations thereof. One suitable ballistic material is a woven 1680 denier ballistic Nylon sold by RockyWoods, which has a weight of approximately 12 ounces per square yard (oz/sq yd), a polyurethane coating of approximately 1-1.25 oz/sq yds on one side for water resistance, and a durable water repellent ("DWR") finish on the opposite side. Other suitable materials include 1050 ballistic nylon and Cordura, both with and without the polyurethane coating and DWR.

Examples of suitable extensible materials from which the case body and liner may be made include, but are not limited to elastane, and the like.

Those of ordinary skill in the art will recognize that a combination of the foregoing materials and techniques can be used to make flexible protective inserts for a variety of devices that need to be protected. Cases incorporating the protective inserts provide improved protection from impact on the outer edges of a device. For ease of discussion, the term "flexible," as used herein, means the ability of the case to move by bending, twisting, flexing and/or stretching, and the like.

Suitable materials and methods of making certain of the multilayer protective inserts and case bodies are disclosed in U.S. Publication Nos. 2007/0261274, 2012/00084896 and 2012/0261289, the subject matter of which is incorporated herein by reference in its entirety.

The cases disclosed herein can comprise one or more of the following advantages: 1) the provide lightweight impact resistance; 2) certain of the case described above are flexible, and can accommodate devices of different dimensions, in contrast to other types of cases, which are designed specifically for one type of device; 3) improved economics as a result of the methods of making the panels and retaining devices; and 4) the encapsulated protective inserts provide items that are rugged, durable, and able to withstand the temperatures, detergents and mechanical action used in industrial and/or commercial laundering, unlike other cases, which cannot be washed, or tend to degrade under such harsh conditions.

It should be noted that the terms "first," "second," and the like herein do not denote any order or importance, but rather are used to distinguish one element from another, and the terms "a" and "an" herein do not denote a limitation of quantity, but rather denote the presence of at least one of the referenced items. Similarly, it is noted that the terms "bottom" and "top" are used herein, unless otherwise noted, merely for convenience of description, and are not limited to any one position or spatial orientation. In addition, the modifier "about" used in connection with a quantity is inclusive of the stated value and has the meaning dictated by the context (e.g., includes the degree of error associated with measurement of the particular quantity).

Compounds are described herein using standard nomenclature. For example, any position not substituted by an indicated group is understood to have its valency filled by a bond as indicated, or a hydrogen atom A dash ("-") that is not between two letters or symbols is used to indicate a point of attachment for a substituent.

For example, —CHO is attached through the carbon of the carbonyl group. Unless defined otherwise herein, all percentages herein mean weight percent ("wt. %"). Furthermore, all ranges disclosed herein are inclusive and combinable (e.g., ranges of "up to about 25 weight percent (wt. %), with about 5 wt. % to about 20 wt. % desired, and about 10 wt. % to about 15 wt. % more desired," are inclusive of the endpoints and all intermediate values of the ranges, e.g., "about 5 wt. % to about 25 wt. %, about 5 wt. % to about 15 wt. %", etc.). The notation "+/−10% means that the indicated measurement may be from an amount that is minus 10% to an amount that is plus 10% of the stated value.

Finally, unless defined otherwise, technical and scientific terms used herein have the same meaning as is commonly understood by one of skill in the art to which this disclosure belongs.

While the disclosure has been described with reference to exemplary embodiments, it will be understood by those skilled in the art that various changes may be made and equivalents may be substituted for elements thereof without departing from the scope of the disclosure. In addition, many modifications may be made to adapt a particular situation or material to the teachings of the disclosure without departing from the essential scope thereof. Therefore, it is intended that the disclosure not be limited to the particular embodiment disclosed as the best mode contemplated for carrying out this disclosure, but that the disclosure will include all embodiments falling within the scope of the appended claims.

What is claimed is:

1. A protective insert for a protective case, comprising:

a longitudinal body comprising a front surface and a back surface opposite to the front surface;

at least one longitudinal protective element disposed at the front surface, the at least one longitudinal protective element comprising an upper surface and a sidewall extending downwardly from the upper surface, wherein the at least one longitudinal protective element further comprises a body that comprises a base layer and a surface layer, and a polymeric material encapsulated by the base layer and the surface layer;

a plurality of channels defined in the at least one protective element, each of the channels disposed about perpendicular to the at least one protective element and comprising a sidewall extending downwardly from the upper surface; and a plurality of cushioning regions defined by the plurality of channels, disposed in the at least one protective element.

2. The protective insert of claim 1, further comprising a longitudinal channel disposed in the at least one longitudinal protective element to define at least two longitudinal protective sub-elements.

3. The protective insert of claim 2, wherein each of the at least two longitudinal protective sub-elements comprises a plurality of cushioning medallions defined by the plurality of channels disposed between the cushioning medallions.

4. The protective insert of claim 1, wherein the channel sidewalls are perpendicular to the upper surface.

5. The protective insert of claim 1, wherein the channel sidewalls define an angle $\theta$.

6. The protective insert of claim 1, wherein each of the cushioning medallions has a length, and the length of each of the at least two longitudinal protective sub-elements varies.

7. The protective insert of claim 1, wherein the channel sidewalls define an angle $\beta$.

8. The protective insert of claim 7, further comprising a channel disposed between the sidewall of the at least one longitudinal protective element and a flange.

9. The protective insert of claim 1, further comprising a flange extending outwardly from the sidewall of the at least one longitudinal protective element.

10. The protective insert of claim 1, wherein the surface layer is continuously bonded to the polymeric material.

11. The protective insert of claim 1, wherein the base layer is continuously bonded to the polymeric material.

12. The protective insert of claim 1, wherein the surface layer and the base layer are both continuously bonded to the polymeric material.

13. The protective insert of claim 1, wherein the polymeric material is a rate dependent foam.

14. The protective insert of claim 13, wherein the rate dependent foam comprises a polyurethane foam.

15. The protective insert of claim 1, wherein each of the base layer and the surface layer are selected from the group consisting of film, fabric, composites thereof, and combinations of the foregoing.

16. The protective insert of claim 15, wherein the film is a thermoplastic polyurethane elastomer.

17. The protective insert of claim 1, disposed in a case comprising opposing walls and a sidewall connected to the opposing walls.

18. The protective insert of claim 17, wherein the protective insert is disposed in the sidewall.

19. The protective insert of claim 17, further comprising a protective insert disposed on one or both of the opposing walls.

* * * * *